US005220139A

United States Patent [19]

Leleve

[11] Patent Number: 5,220,139

[45] Date of Patent: Jun. 15, 1993

[54] HIGH SECURITY HIGH TENSION LAMP AND CONNECTOR ASSEMBLY, IN PARTICULAR FOR CAR LIGHTING

[75] Inventor: Joël Leleve, Epinay sur Seine, France

[73] Assignee: Valeo Vision, Bobigny Cedex, France

[21] Appl. No.: 807,404

[22] Filed: Dec. 12, 1991

Related U.S. Application Data

[63] Continuation of Ser. No. 513,823, April 24, 1990, abandoned.

[30] Foreign Application Priority Data

Apr. 26, 1989 [FR] France ..... 89 05540

[51] Int. Cl.[5] ..... H01R 33/96

[52] U.S. Cl. ..... 200/51.009; 200/51.1; 200/51.13; 439/181

[58] Field of Search ..... 200/51.09, 51.1, 51.11, 200/51.12, 51.13; 439/181; 362/226

[56] References Cited

U.S. PATENT DOCUMENTS

| | | | |
|---|---|---|---|
| 2,016,121 | 10/1935 | Rowe | 200/51.10 |
| 3,090,948 | 5/1963 | Cremer | 200/51.10 |
| 3,710,047 | 1/1973 | Brzozowski et al. | 200/51.10 |
| 3,903,385 | 9/1975 | Moyer et al. | 200/51.1 |
| 4,034,172 | 7/1977 | Glover et al. | 200/51.10 |
| 4,170,939 | 10/1979 | Hoheisel et al. | 200/51.10 |
| 4,438,303 | 3/1984 | Astier | 200/51.11 |
| 4,594,490 | 6/1986 | McCullough | 200/51.09 |

FOREIGN PATENT DOCUMENTS

| | | | |
|---|---|---|---|
| 534435 | 2/1973 | Fed. Rep. of Germany | 424/665 |
| 1197299 | 7/1970 | United Kingdom | 200/51.10 |
| 2025711 | 1/1980 | United Kingdom | 102/202.2 |

*Primary Examiner*—Henry J. Recla
*Assistant Examiner*—David J. Walczak

[57] ABSTRACT

A high tension lamp and connector assembly, in particular for motor vehicle lighting, the lamp and the connector including at least two electrically conductive and complementary connection elements for feeding the lamp. A conducting member is provided in a region of the connector which is not immediately accessible, the conducting member serving in the absence of external thrust to establish mutual electrical contact between the the connection elements of the connector, thereby short-circuiting the connection elements. The lamp bears at least one actuator element which, when the lamp is correctly installed in the connector, urges the conductive member in such a manner as to cause it to break the electrical contact between the connection elements of the connector. The invention is applicable to improving safety while handling arc lamps for headlights.

13 Claims, 1 Drawing Sheet

HIGH SECURITY HIGH TENSION LAMP AND CONNECTOR ASSEMBLY, IN PARTICULAR FOR CAR LIGHTING

This is a continuation of co-pending application Ser. No. 07/513,823 filed on Apr. 24, 1990, now abandon.

The present invention relates to a high tension lamp and connector assembly, in particular for a motor vehicle headlight, and including means for avoiding any danger of electrocuting the user when the lamp is withdrawn from the connector or when it is wrongly positioned thereon.

BACKGROUND OF THE INVENTION

Arc lamps provide excellent light yield, and are now beginning to be used in vehicle headlights instead of conventional filament lamps.

However, the use of lamps of this type is disadvantageous in that they need to be fed with electrical voltages that are high, and more particularly they need to be fed with a voltage of about ten thousand volts for triggering purposes, and a voltage of about 80 volts for maintaining the arc once it has been established.

It will therefore be understood that such lamps and their associated connectors must be handled with very considerable care in order to avoid any danger of electrocution, for example if the fingers of the user should accidentally come into contact with metal parts that convey lamp feed current.

In this respect, the major risk is that an unexpecting user accustomed over the years to using very low voltage filament lamps will quite simply fail to take any special precautions at all when handling this new type of lamp and its connector.

It is therefore necessary to ensure that such a user does not run any risk of electrocution.

SUMMARY OF THE INVENTION

The present invention seeks to provide a solution to this problem. Thus, it provides a high tension lamp and connector assembly, in particular for motor vehicle lighting, the lamp and the connector including at least two electrically conductive and complementary connection elements for feeding the lamp, wherein a conducting member is provided in a region of the connector which is not immediately accessible, said conducting member serving in the absence of external urging to establish mutual electrical contact between the said connection elements of the connector, thereby short-circuiting said connection elements, and wherein the lamp bears at least one actuator element which, when said lamp is correctly installed in the connector, urges said conductive member in such a manner as to cause it to break the electrical contact between the said connection elements of the connector.

Preferably, the conductive member deforms elastically when it is being urged. Advantageously, the conductive member comprises a resilient blade having a first end permanently fixed to a first conductor element for feeding the lamp with current, and a free opposite end facing a second current feeding conductor element, with the actuator member(s) urging against the surface of the blade situated between said ends.

The at least one actuator element is constituted by a rigid rod which is electrically insulating and which extends parallel to the direction of lamp-inserting motion, and the said region which is not immediately accessible is then advantageously an internal cavity of a connector body, with at least one passage being provided for inserting the said at least one rigid rod into the said cavity.

Advantageously, the lamp is an arc lamp for a motor vehicle headlight.

The invention also provides a motor vehicle lighting circuit characterized in that it includes a connector and lamp assembly as defined above together with a lamp power supply circuit including means for self-protection against short circuits.

BRIEF DESCRIPTION OF THE DRAWING

An embodiment of the invention is described by way of example with reference to the accompanying drawing, in which.

DETAILED DESCRIPTION

Figure 1:
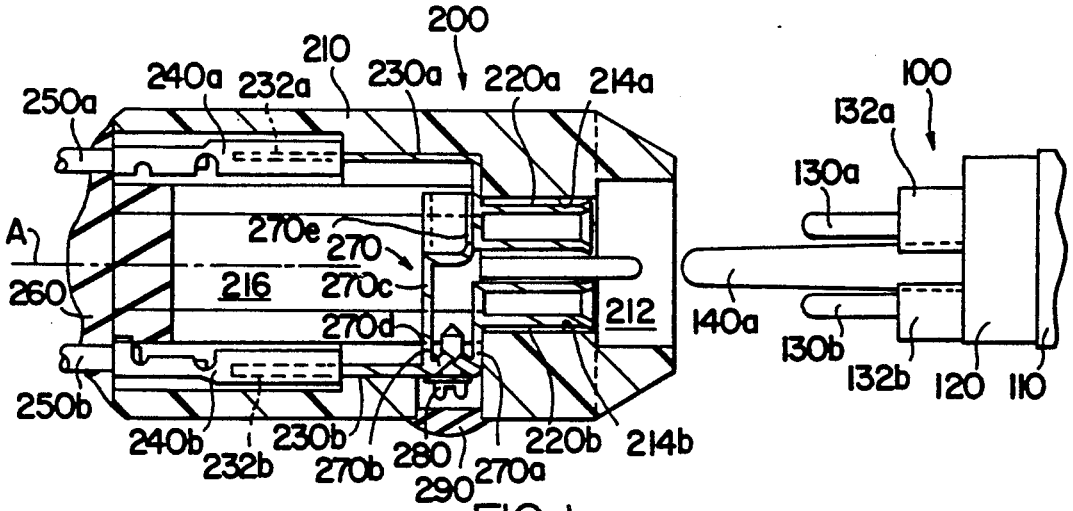
FIG. 1 is a vertical axial section through a connector/lamp assembly where the connector is designed in accordance with the invention, and with the assembly shown in a first relative disposition.

With reference to the drawing, a portion of an arc lamp 100 is shown, said lamp comprising a sealed bulb 110 and a base 120. Two electrical connection pins 130*a* and 130*b* carried by two studs 132*a* and 132*b* fixed to the base extend in parallel rearwards from the base. Two rigid electrically insulating rods 140*a* and 140*b* also extend rearwards parallel to the pins 130*a* and 130*b* and they extend over a considerably longer distance axially than do the pins. The purpose of these rods is to ensure that the lamp is positioned stably and optionally, if they are asymmetrically disposed, to act as keying means for ensuring that the lamp is inserted in the correct orientation.

In the present example, the pins and the rods are essentially cylindrical and their respective axes are contained in two axial planes, with the pins being in a vertical plane and the rods in a horizontal plane.

The connector 200 comprises a body 210 made of insulating material such as a plastic material, and it is generally cylindrical in shape. The leading end of the body 210 is provided with a cavity 212 for receiving the studs 132*a* and 132*b*, and the bottom of the cavity is provided with two cylindrical passages 214*a* and 214*b* for receiving the pins 130*a* and 130*b*, and with two cylindrical passages (not shown) for receiving the rods 140*a* and 140*b*. These passages include female connection elements for co-operating with the pins and constituted by two metal sleeves 220*a* and 220*b* which flare forwards (to the right in FIGS. 1 and 2) in order to facilitate insertion of the pins 130*a* and 130*b* when the lamp 100 is put into place.

A first conductor element 230*a* has a generally L-shaped profile, with a first branch thereof extending radially and fixed to the corresponding sleeve 220*a* (e.g. by welding), while the second branch thereof extends axially with its free end constituting a metal terminal 232*a* suitable for receiving a female terminal 240*a* constituting a first current feed for the lamp and connected to an appropriate power supply by a first flexible conductor 250*a*.

Similarly, a second conductor element 230*b* is substantially symmetrical to the first about the horizontal axis A and provides electrical connection between the second sleeve 220*b* and a second current feed female terminal 240*b*, and for this purpose the free end of its axial branch defines a complementary male terminal 232*b*. The female terminal 240*b* is connected to the second terminal of an appropriate power supply by a second flexible conductor 250*b*.

The conductors 230*a* and 230*b*, and the terminals 232*a*, 232*b*, and 240*a*, 240*b* are received in the inside space 216 of the connector body 210, said space being practically inaccessible to the user so as to avoid any risk of electrocution by the high voltages conveyed by the various conducting parts in order to power the arc lamp. The above-mentioned cylindrical passages for the pins and the rods pass through the body and into the cavity.

An appropriate plug 260, e.g. made of an insulating material which can be cast when hot serves to close the inside cavity 216 in substantially tamperproof manner at its rear end, merely allowing the flexible conductors 250*a* and 250*b* to pass through the plug.

In accordance with the invention, means are provided in this lamp/connector assembly for establishing a short circuit between the two current feeds provided in the connector whenever the lamp 100 is removed from the connector or is wrongly positioned thereon.

In the embodiment described and shown, these means comprise a one-piece metal short-circuiting member 270 extending across the inside of the cavity 216. In practice, the electrical connection between the sleeve 220*b* and the current feed is provided both by the conductor element 230*b* and by a portion of said member, as explained below.

In terms of mechanical structure, the short-circuiting member 270 is in the form of a U-shaped member comprising two radial branches projecting from a base which extends parallel to the axis A. More precisely, a first branch 270*a* constitutes the radial branch of the conductor element 230*b* and its top end is welded to the sleeve 220*b*. The base 270*b* of the U-shape is pressed firmly against the conductor elements 230*b* by means of a screw 280, with the conductor element 230 being reduced in this case merely to its axial branch. The screw 280 passes through the elements 230*b* and 270 and it co-operates with tapping formed in the said base 270*b*. The screw, which may be raised to a high potential, is masked by an insulating cap 290.

The element 230*b* extends to the left as far as the male terminal 232*b*. Thus, the path followed by the current between the sleeve 220*b* and the terminal 232*b* is provided in this case on a permanent basis by the branch 270*a* of the member 270, the base 270*b*, and the conductor element 230*b*, with the base and the conductor element being held together by the screw 280.

Figure 3:
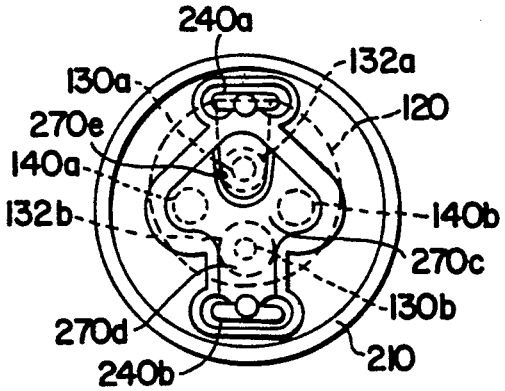
FIG. 3 is a cross-section view through the assembly of FIGS. 1 and 2.

The second branch of the short-circuiting member 270 has a main portion 270*c* which is generally triangular in shape (as shown in FIG. 3), and which is connected to the base 270*b* by a tab 270*d*.

The regions of the two vertices of the triangle which are adjacent to the tabs 270*d* constitute bearing zones for the free ends of the rods 140*a* and 140*b* of the lamp 100. The region of the third vertex, distant from said tab 270*d*, faces the radial branch of the first conductor element 230*a* and is in the form of a notch 270*e* directed towards said branch.

The shape of the piece 270 when no force is applied thereto is such that when put into place in the cavity 216 as shown in FIG. 1 and fixed by means of the screw 280, its notch 270*e* bears resiliently against the radial branch of the element 230*a* and the underlying sleeve 220*a*, thereby short-circuiting the two current feeds inside the connector. This can be achieved, for example, by ensuring that when no force is applied, the main plane of the tab 270*d* and of the portion 270*c* lies at an angle of slightly less than 90° relative to the plane of the base 270*b*.

The lamp/connector assembly as described above operates as follows: when a lamp 100 is not installed in its connector 200 (FIG. 1), then the member 270 ensures that the two current feeds are short-circuited together inside the connector as described above, thereby shorting together the two sleeves 200*a* and 220*b* constituting the female connectors. The potential difference between these two elements is therefore zero and there is no danger of electrocution even if the user's fingers should accidentally come into contact with the accessible ends of the said sleeves.

Figure 2:
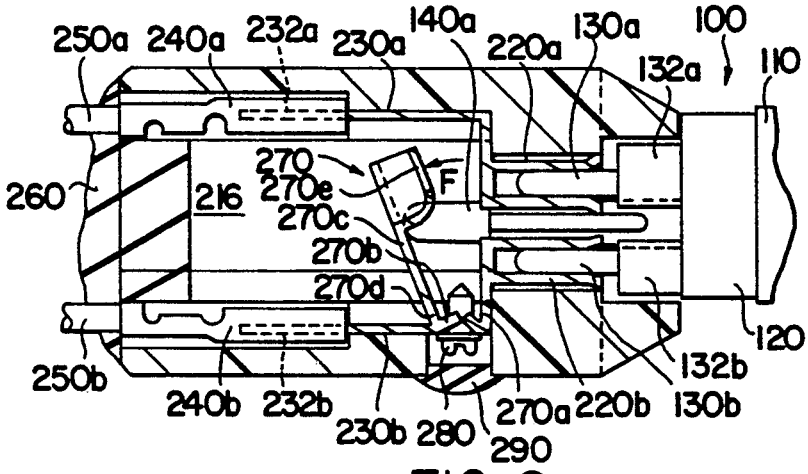
FIG. 2 is a vertical axial section view through the assembly of FIG. 1 shown in a second relative disposition.

When the lamp 100 is inserted in its connector 200, then its two rods penetrate into the cavity 216 after passing through their respective passages, thereby acting as actuators for applying thrust to the conductor member, their free ends bear against the triangular blade 270*c* which then deforms resiliently in the direction of arrow F against the resilient force which previously served to provide the short circuit. FIG. 2 shows the situation in which the lamp has almost reached its final position, and it can be seen that under the effect of the above-mentioned thrust, the notch 270*e* has released the conductor 230*a* and the two current feeds are now isolated from each other. The lamp 100 can then be powered in the normal manner.

Clearly, in order to obtain the desired behavior over a long period of time, the short-circuiting member 270 must be made of a metal or an alloy having good elastic qualities so as to avoid it becoming permanently deformed which would prevent it from re-establishing the short circuit when the lamp is subsequently removed.

It may be observed that with the disposition described, the short circuit is maintained at least until both pins 130*a* and 130*b* which are already in electrical contact with the associated female elements, are no longer accessible to the fingers of the user, being masked by the studs 132*a* and 132*b* beginning to penetrate into their associated cavities 210 in the connector.

It may also be observed that the short circuit which ensures user safety is established not only when the lamp is fully withdrawn, but also when it is wrongly positioned on the connector.

Naturally, the lamp/connector assembly of the present invention must be used together with a power supply including special protection means that act when its two output terminals are short-circuited. It is essential to ensure that the power supply is not damaged by the short circuit being established within the connector as a lamp 100 is removed or because the lamp takes up a wrong position while the power supply is in operation.

Advantageously, use will be made of the means for providing protection against short circuits as described in the present Applicants' French patent application filed the same day as the present application and entitled "Motor vehicle lighting circuit including means for providing protection against short circuits".

Naturally, the present invention is not limited in any way to the embodiment described above and shown in the drawings, and the person skilled in the art will be able to make numerous variants or modifications in accordance with the spirit of the invention. Thus, given the high degree of safety offered by the invention it would be possible without danger to provide male connection elements on the connector and female connection elements on the lamp, in contradiction to the above description.

Thus, the connector pins, although readily accessible, are short-circuited whenever the lamp is removed and therefore free from danger.

I claim:

1. An assembly of a lamp and connector and a high voltage power supply means for said lamp, said lamp and connector adapted to be installed within a motor vehicle headlight, said power supply means having means for establishing a short-circuit between a pair of output terminals, said connector including at least two electrically conductive and complementary connection elements connected to said output terminals for feeding the lamp, wherein a conductive member is provided in a region of the connector which is not accessible by operator's fingers, said conductive member serving in the absence of external urging to establish mutual electrical contact between said connection elements of the connector, thereby short-circuiting said connection elements and avoiding any danger of electrical shock to the operator and wherein a base of the lamp bears at least one actuator element which, when said lamp is correctly installed in the connector, passes through at least one corresponding passage provided in a wall between the outside of said connector and said region and urges said conductive member in such manner as to cause it to break the electrical contact between the connection elements of the connector so that said high voltage can be applied to the lamp.

2. An assembly according to claim 1, wherein the conductive member deforms elastically when it is being urged.

3. An assembly according to claim 2, wherein the conductive member comprises a resilient blade having a first end permanently fixed to a first conductor element for feeding the lamp with current, and a free opposite end facing a second current feeding conductor element, with the actuator member urging against the surface of the blade situated between said ends.

4. An assembly according to claim 3, wherein the at least one actuator element is constituted by a rigid rod which is electrically insulating.

5. An assembly according to claim 4, wherein said region which is not immediately accessible is an internal cavity of a connector body, and wherein at least one passage is provided for inserting said at least one rigid rod into said cavity.

6. An assembly according to claim 1, wherein the lamp is an arc lamp adapted to be installed within a motor vehicle headlight.

7. An assembly of a lamp and connector and a high voltage power supply means for said lamp, said lamp and connector adapted to be installed within a motor vehicle headlight, said power supply means having means for establishing a short-circuit between a pair of output terminals, said connector including at least two electrically conductive and complementary connection elements connected to said output terminals for feeding the lamp, wherein a conductive member is provided in a substantially closed cavity defined by the connector, said conductive member serving in the absence of external urging to establish mutual electrical contact between said connection elements of the connector, thereby short-circuiting said connection elements and avoiding any danger of electrical shock to the operator and wherein a base of the lamp bears at least one actuator element substantially narrower than said base which, when said lamp is correctly installed in the connector, passes through at least one corresponding passage provided in a wall between the outside of said connector and said cavity in said connector and urges said conductive member in such manner as to cause it to break the electrical contact between the connection elements of the connector so that said high voltage can be applied to the lamp.

8. An assembly according to claim 7, wherein the conductive member deforms elastically when it is being urged.

9. An assembly according to claim 8, wherein the conductive member comprises a resilient blade having a first end permanently fixed to a first conductor element for feeding the lamp with current, and a free opposite end facing a second current feeding conductor element, with the actuator member urging against the surface of the blade situated between said ends.

10. An assembly according to claim 9, wherein the at least one actuator element is constituted by a rigid rod which is electrically insulating.

11. An assembly according to claim 10, wherein said region which is not immediately accessible is an internal cavity of a connector body, and wherein at least one passage is provided for inserting the said at least one rigid rod into the said cavity.

12. An assembly according to claim 7, wherein the lamp is an arc lamp for a motor vehicle headlight.

13. A method for protecting an operator against electrical shocks when a lamp is removed from a connector and a high voltage power supply means is in operation in a headlight for a motor vehicle including an assembly of a lamp and connector and a high voltage power supply means for the lamp, said power supply means having means for establishing a short-circuit between a pair of output terminals, said connector including at least two electrically conductive and complementary connection elements connected to said output terminals for feeding the lamp, wherein a conductive member is provided in a region in the connector, said conductive member serving in the absence of external urging to establish mutual electrical contact between said connection elements of the connector, and wherein a base of the lamp bears at least one actuator element which, when said lamp is correctly installed in the connector, passes through at least one corresponding passage provided in a wall between the outside of said connector and said region and urges said conductive member in such manner as to cause it to break the mutual electrical contact between the connection elements of the connector, the method including the following steps:

a) when the lamp is removed from said connector, establishing mutual electrical contact between said connection elements of the connector, whereby no potential difference exists between said connection elements and no risk of electrical shock exists for the operator;

b) establishing in said power supply means said means for establishing o short-circuit, whereby said power supply means are not overloaded by said mutual electrical contact;

c) when a lamp is placed into said connector, breaking said mutual electrical contact by means of said at least one actuator element; and d) disabling said means for establishing a short-circuit in said power supply means, whereby said lamp can be energized by said power supply means.

* * * * *